US006257559B1

(12) United States Patent
Mouri

(10) Patent No.: US 6,257,559 B1
(45) Date of Patent: Jul. 10, 2001

(54) PORTABLE FENCE WITH FOLDABLE COMPONENTS

(75) Inventor: Akihiro Mouri, Fukui (JP)

(73) Assignee: Yagikuma & Co., Ltd., Fukui (JP)

( * ) Notice: Subject to any disclaimer, the term of this patent is extended or adjusted under 35 U.S.C. 154(b) by 0 days.

(21) Appl. No.: 09/368,489

(22) Filed: Aug. 5, 1999

(30) Foreign Application Priority Data

Aug. 7, 1998 (JP) ..... 10-223971

(51) Int. Cl.[7] ..... E04H 17/16; A47G 5/00

(52) U.S. Cl. ..... 256/26; 256/29; 256/25; 256/19; 256/65; 160/135; 160/351

(58) Field of Search ..... 256/24, 25, 26, 256/19, 65; 160/135, 351; 116/63 R, 63 P, 63 T

(56) References Cited

U.S. PATENT DOCUMENTS

| | | | | |
|---|---|---|---|---|
| 160,046 | * | 2/1875 | Wright | 256/24 |
| 1,635,573 | * | 7/1927 | Bertram | 160/135 |
| 2,451,875 | * | 10/1948 | Ryder | 116/63 R |
| 2,826,906 | * | 3/1958 | Rice | 116/63 R X |
| 4,334,571 | * | 6/1982 | Heller et al. | 160/135 |
| 4,368,586 | * | 1/1983 | Forzelias | 248/411 X |
| 4,792,258 | * | 12/1988 | Goff | 116/63 R X |
| 4,842,035 | * | 6/1989 | Thompson | 160/135 |
| 5,031,683 | * | 7/1991 | Marvy et al. | 160/351 |
| 5,054,507 | * | 10/1991 | Sparks | 160/135 |
| 5,419,065 | * | 5/1995 | Lin | 40/550 |
| 5,758,868 | * | 6/1998 | Shea | 256/19 X |
| 5,881,789 | * | 3/1999 | Melashenko et al. | 160/135 |
| 6,009,930 | * | 1/2000 | Jantschek | 160/135 |
| 6,073,673 | * | 6/2000 | Janutta | 160/135 X |
| 6,102,375 | * | 8/2000 | Colless et al. | 256/26 |

FOREIGN PATENT DOCUMENTS

| | | | | |
|---|---|---|---|---|
| 420320 | * | 11/1934 | (GB) | 160/135 |
| 5-24829 | | 3/1993 | (JP) . | |

* cited by examiner

*Primary Examiner*—Lynne H. Browne
*Assistant Examiner*—Ernesto Garcia
(74) *Attorney, Agent, or Firm*—Snider & Associates; Ronald R. Snider

(57) ABSTRACT

A portable fence is practically easy and fast to be installed along the boundary of a keep-off area to restrict and entry of the unconcerned at construction or events-holding sites and is conveniently compact to carry and store due to its foldability. This fence comprises a conjunction screen formed by connecting a plurality of fence components, preferably formed of synthetic resin by blow molding, side by side through a hinge mechanism such that they are foldable to each other and a support means or stay pivotably mounted onto a lower fringe portion of said conjunction screen, and stably provides a restricted area at a site where an access of the unconcerned is restricted in an easy and fast manner and is convenient to carry and store due to its foldability. The addition of a weight container thereto further enhances the standing stability thereof.

14 Claims, 9 Drawing Sheets

PORTABLE FENCE WITH FOLDABLE COMPONENTS

RELATED APPLICATION

This application claims the priority of the Japanese Patent Application No.10-223971 filed on Aug. 7, 1998.

BACKGROUND OF THE INVENTION

1. Field of the Invention

The present invention relates to the improvement of a portable fence, more specifically, relating to a practical portable fence capable of not only being stably installed in an easy and fast manner along a restricted area to keep off the unconcerned from construction or events-holding sites, but also being so compactly folded that it is convenient to carry and store.

2. Prior Art

As well known, there is a restricted area to keep off the unconcerned at construction or events-holding sites in order to avoid risks and to secure a smooth operation of an event, and for such area, it is required to expressly indicate from where such area begins by closing it off with a rope or wire, or installing a fence along the boundary of such controlled area.

But, with such prior arts as mentioned above, which are intended to be temporarily installed at such sites, it takes a lot of labor and time to put them into practice because it involves striking a plurality of piles with a regular interval therebewteen, standing poles enclosed with a rope or wire or with bars suspended therebetween. Also, upon releasing such restriction, it costs unreasonably high to remove such piles and waste such rope or wire and bars as mentioned above.

Under the circumstances, recently, to define a keep-off area, such method for defining a restricted area is often used as comprising a gatelike fence component with legs provided at its lower end thereof and a foundation block with holes opened therein to receive said legs so as to put said fence component to stand. That is to say, according to this method, as a restricted area is established by disposing said foundation blocks with a certain interval therebetween along the boundary of such area and then inserting said legs into the holes of those foundation blocks, the installation work becomes easier in comparison with the above-mentioned prior arts, and it dispenses with the waste of the materials because those components can be repetitiously used.

However, even with such method as described above, it takes a lot of labor and time not only to dispose those foundation blocks with a fixed interval therebetween by correctly measuring it, but also to insert a number of fence components into the holes of the foundation blocks. Furthermore, to release such restriction of entry or to remove and take out such prior fence, a number of such fence components respectively has to be detached from a number of such block foundations respectively, and it requires a wider space for the storage of those detachable components and foundations.

SUMMARY OF THE INVENTION

Thus, in view of the inconveniences encountered with the prior arts as mentioned above, the present invention is to provide a practical portable fence capable of being stably installed in an easy manner along the boundary of a restricted area to keep off the unconcerned and being so compactly folded that it is convenient to carry and store.

To solve the above issue, the present invention discloses a portable fence with foldable components comprising a screen formed by connecting a plurality of fence components side by side by means of a hinge means such that they are foldable to each other and a stay relatively rotating to said fence component so as to adjust its plane angle with regard thereto for the stabilization thereof.

The portable fence disclosed in this invention is easy and fast to join and disjoin at its hinged portions, and if made of a synthetic resin capable of blow or injection moulding, it further enhances its weight reduction and productivity. Furthermore, by the addition of a weight container mountable on the stay, the standing stability of the portable fence further improves.

Hereinafter, the preferred embodiments of the present invention are concretely described with reference to the accompanying drawings.

DESCRIPTION OF THE PREFERRED EMBODIMENT

Figure 1:
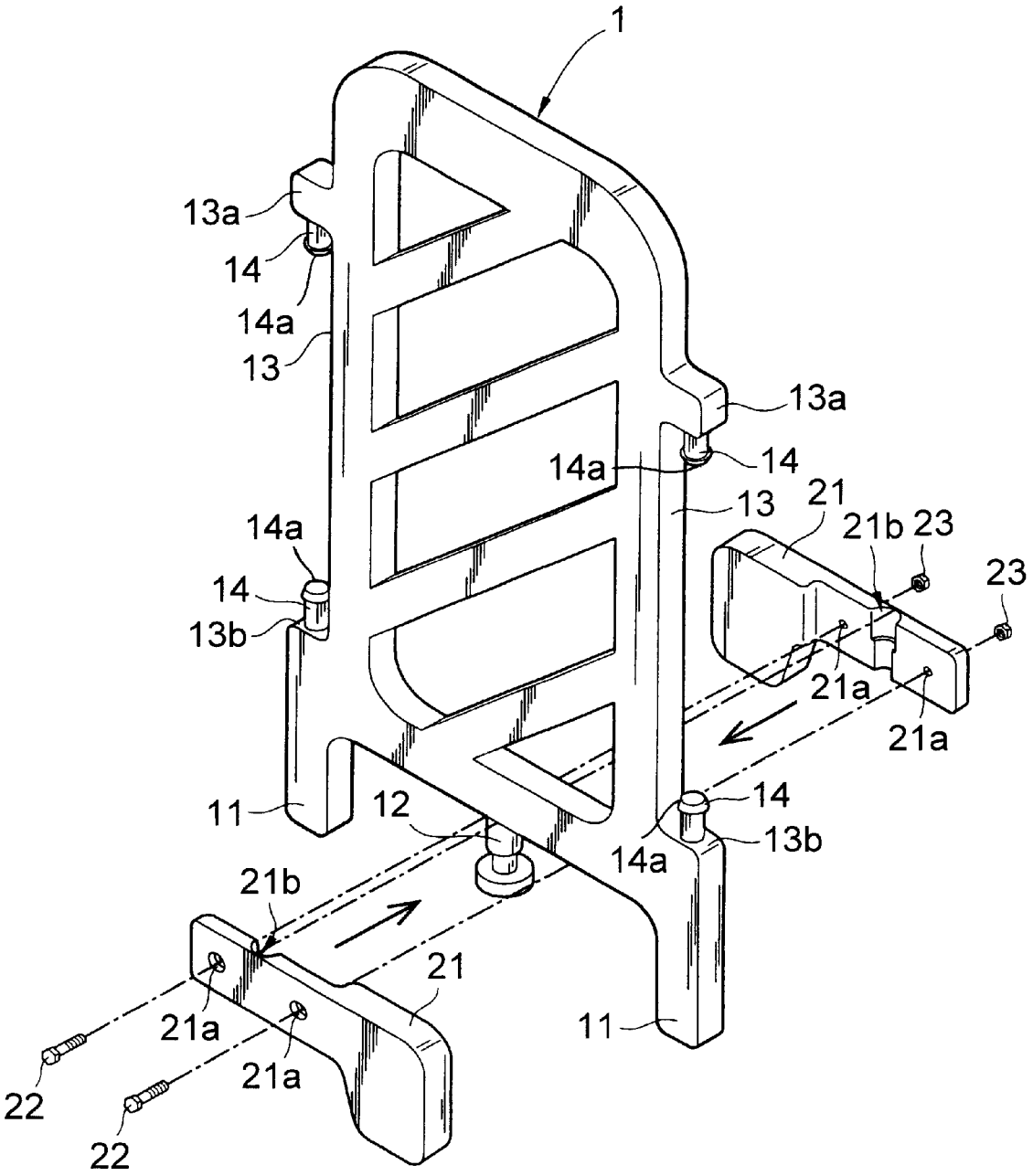
FIG. 1 is an exploded perspective view showing a stay mounted on the lower part of a fence component of the portable fence embodied in the present invention.
Figure 3:
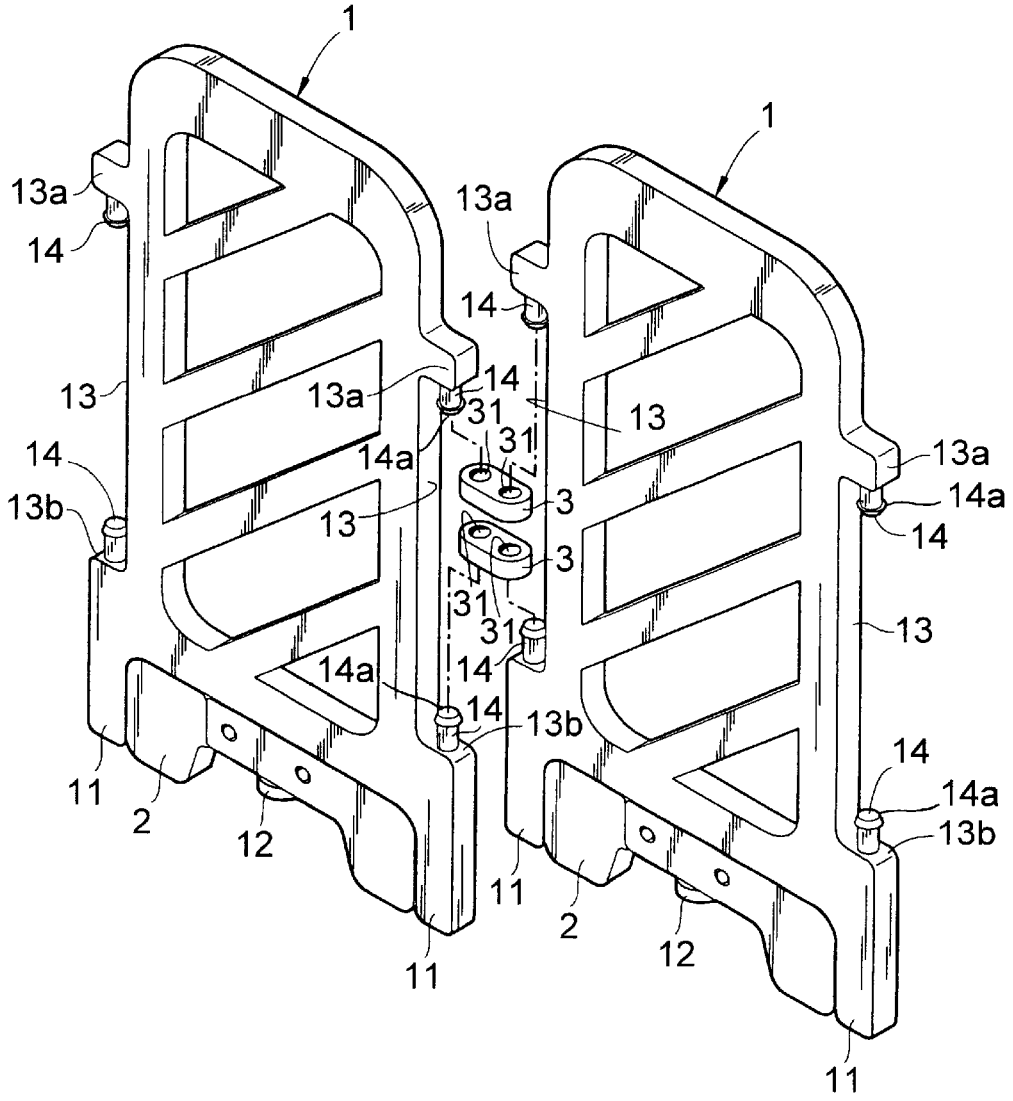
FIG. 3 is an exploded perspective view showing two fence components connected to each other by means of bi-axial hinges.
Figure 4:
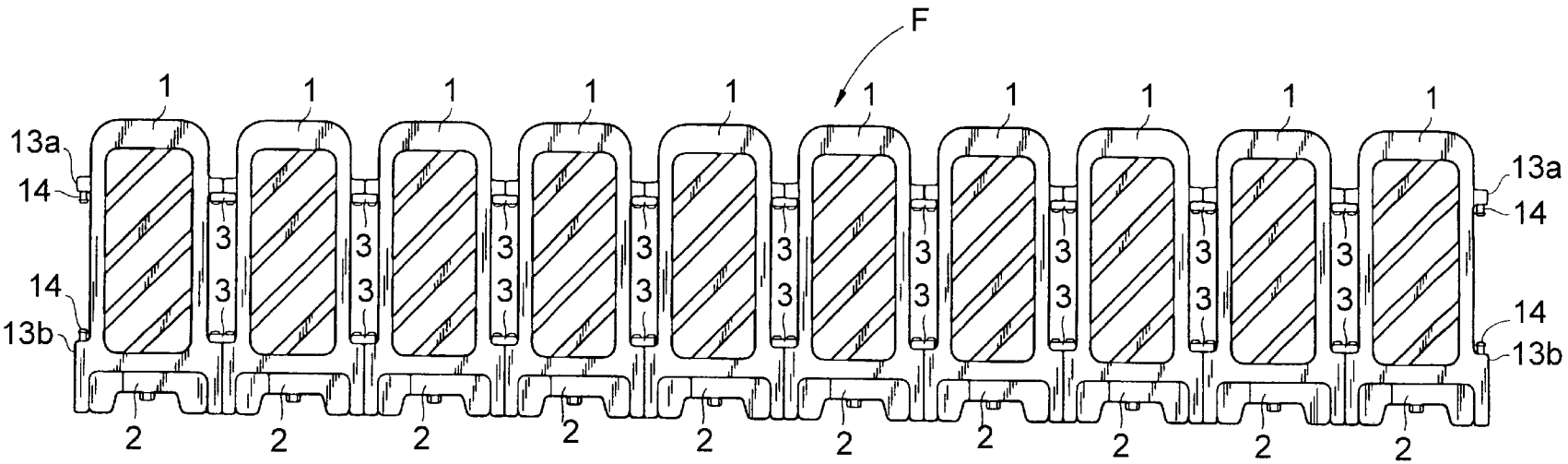
FIG. 4 is a frontal view of the portable fence embodied in the present invention showing ten fence components connected to each other by means of bi-axial hinges.
Figure 5:
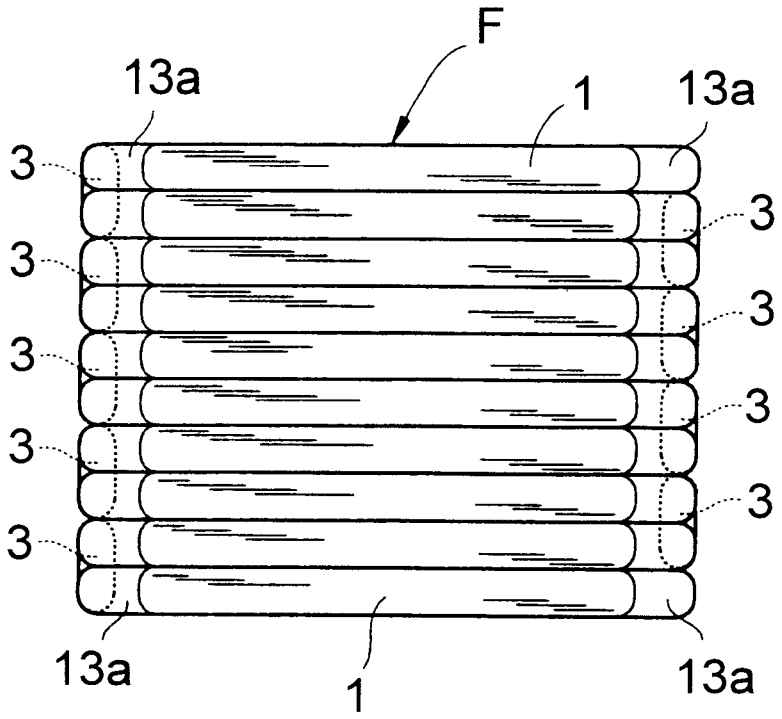
FIG. 5 is a plan view showing the portable fence as shown in FIG. 4 folded.

In FIGS. 1 to 6, numeral 1 indicates a fence component of a portable fence embodied in the present invention. The lower fringe portion of said fence component is cut out in a gatelike shape and is provided with legs (11) and (11) at both sides. As shown in FIG. 1, a stay pivot mount (12) to pivotably mount a stay as mentioned below is provided on the under side surface of the cut-out portion interposed between those legs (11) and (11). At the upper part of the right-and left sides (13) and (13) respectively of said fence component (1), a protrusive portion **(13*a*) is formed while at the lower part thereof, a projected portion (13*b*) is formed, those portions protruding substantially to the same extent. On the under side of said portion (13*a*) and on the upper side of said portion (13*b*) respectively, a bi-axial hinge pin (14) is provided. These bi-axial hinge pins (14) are opposedly disposed to each other. A fence component (1) is made of synthetic resin (e.g., ultra high molecular polyethylene) by means of blow moulding, so that it is light in weight and excellent in shockproof. A conjunction screen foldable as shown in FIG. 5** is formed by connecting a plurality of such fence components to each other side by side.

Figure 2:
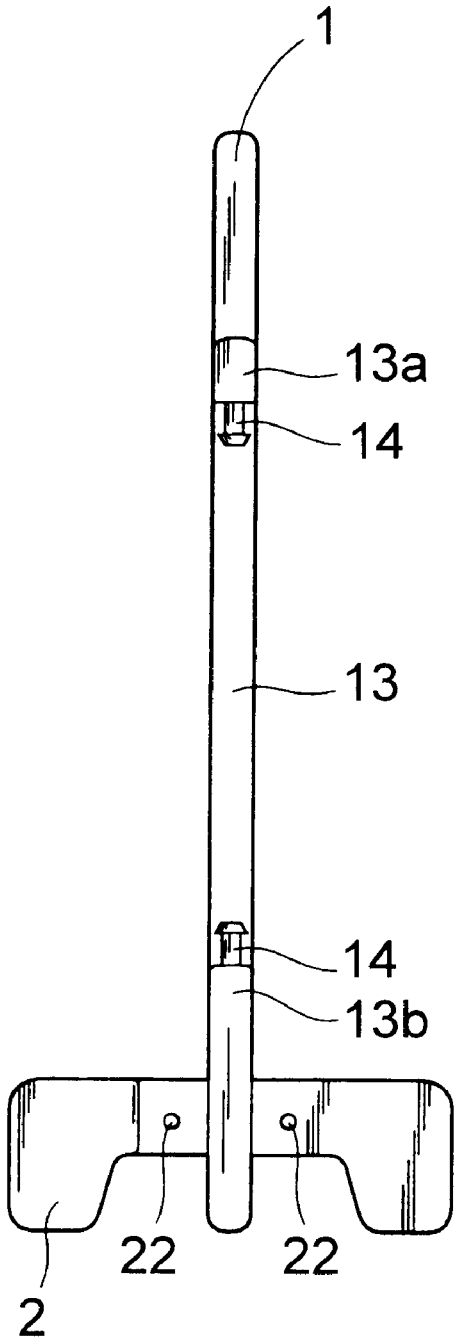
FIG. 2 is a side view showing the stay rotated substantially perpendicular to the fence component.

Numeral 2 indicates a stay to be mounted on the lower part of said fence component (1). This stay comprises a pair of mobile pieces (21) and (21) combined together, said pieces being identical in shape. Two holes (21*a*) and (21*a*) are bored through the respective mobile pieces to the thickness direction thereof, on one side of which a concave portion (21*b*) being formed in the middle of those holes to fit into a stay pivot mount (12) protrusively provided on the lower part of the fence component. As shown in FIG. 1, with said stay pivot mount (12) received into a hole formed by opposedly facing a concave portion of the respective mobile pieces (21) and (21), a bolt (22) is inserted into the respective holes (21*a*) and screwed with a nut (23), thereby, said stay is pivotably mounted onto the stay pivot mount (12). This makes it possible to relatively rotate said stay to the plane of the fence component. For example, as shown in FIG. 2, by the perpendicular rotation of the stay to the plane of the fence component, it allows the fence component to stably stand. A notch means being adopted for connection between the stay (2) and stay pivot mount (12), it can control and regulate the movement of the stay within an appropriate angle to the plane of the fence component. This stay is made of synthetic resin (e.g., ultra high-molecular polyethylene) like the fence component.

Numeral 3 indicates a bi-axial hinge to connect the sides (13) and (13) of the adjacent fence components (1) and (1). This hinge has an oval body with two holes (31) and (31) bored therethrough. In this embodiment, as shown in FIG. 3, two bi-axial hinges are in use. The adjacent fence components are foldably connected to each other by mounting the holes (31) and (31) of the respective bi-axial hinges (31) into the bi-axial hinge pin (14) provided on the under side of the adjacent protrusive portions (13*a*) and (13*a*) respectively and into that provided on the upper side of the adjacent projected portions (13*b*) and (13*b*) respectively. With the bi-axial hinge mechanism as mentioned above, one fence component has a greater latitude of movement against the other, so that the mutual adjustment of an angle made by one plane and the other becomes easy. This bi-axial hinge is easy to detach from the vertical bi-axial hinge pin (14), so that the plurality of fence components in conjunction are free to disjoin.

Biaxial hinge pins (14) extend upward from projecting portions (13*b*) and downward from protrusion portion (13*a*). Each of the biaxial hinge pins (14) has an expanded diameter portion (14*a*) at its end portion. The end portions are not connected to any other structure which permits the biaxial hinges (3) to be fitted onto the hinge pins (14) as shown in FIG. 3. The pins (14) are inserted into hole (31) which are through biaxial hinge (3). As shown in FIG. 3, the inside diameter of holes (31) is smaller than the outside diameter of expanded portion (14*a*). This, therefore, provides for retention of the biaxial hinges (3) on the hinge pins (14), as shown in FIG. 4.

In this way, by connecting a number of fence components (1)·(1)··by means of the above-mentioned bi-axial hinges (3)·(3) ··, as shown in FIG. 4, a portable fence (F) foldable like a screen is obtained. FIG. 4 shows said fence comprising ten fence components, but the extensive length of the fence (F) is adjustable as desired, which is realized by varying the number of fence components to be connected. As shown in FIG. 5, the fence (F) as obtained this way is compactly folded just by sequentially overlaying the adjacent fence components one over another, so that it becomes convenient to carry and store. As for the stay (2) pivotably mounted in the cut-out portion provided on the lower part of the respective fence components, it can be contained in the cut-out portion flush to the side surfaces of the fence component, so that it does not interrupt the fence (F) from being folded as shown in FIG. 5.

Figure 6:
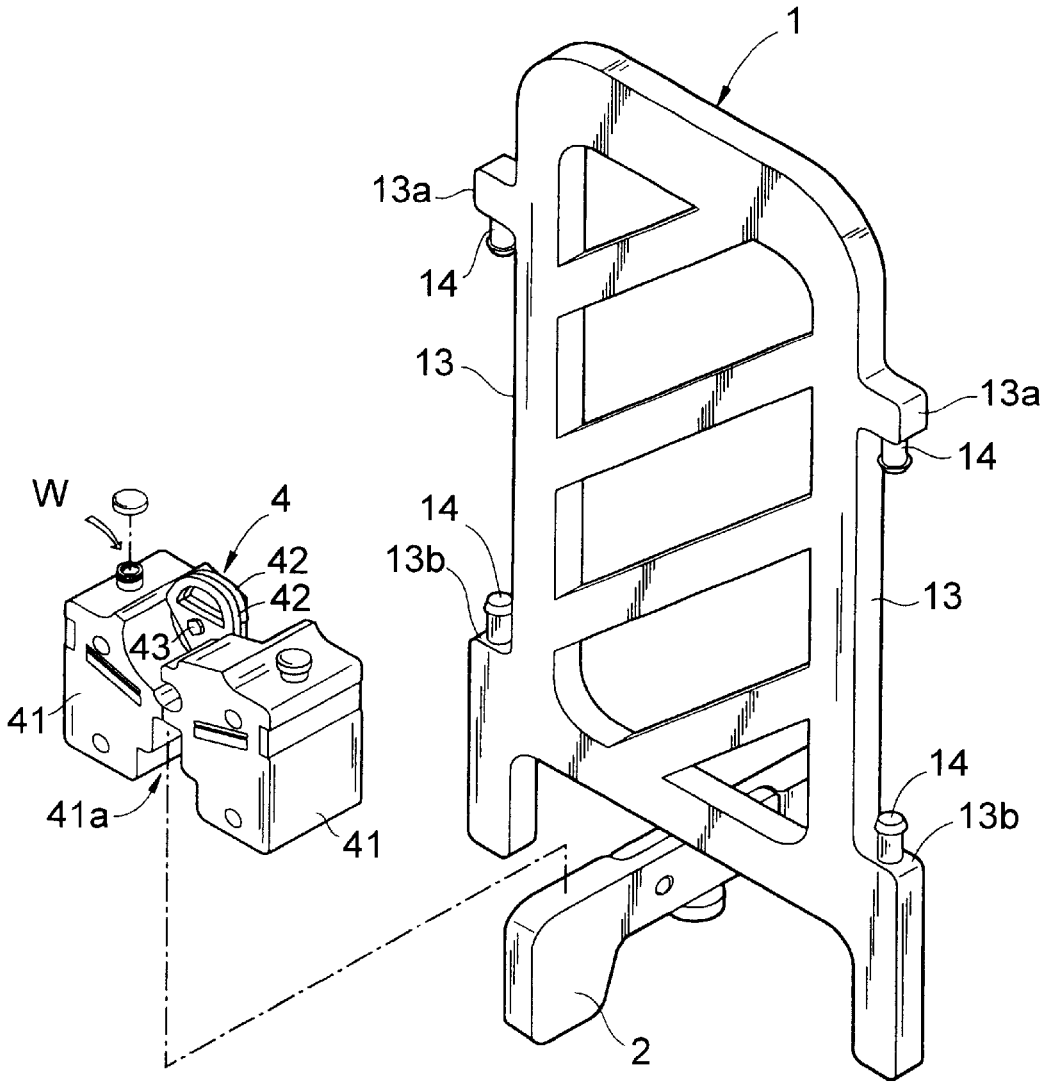
FIG. 6 is an exploded perspective view showing a weight container mounted onto the stay rotated perpendicularly to the plane surface of the fence component.

Numeral 4 indicates a weight container to be placed upon the stay, which is formed of synthetic resin (e.g., ultra high-molecular polyethylene) by means of blow moulding. This container comprises a pair of hollow block pieces (41) and (41) in which a weight (W) such as water and sand can be filled; a disk-like hinge plate (42) integrally moulded on the upper part of the respective block pieces; and a connecting pin (43) to hinge those plates. As shown in FIG. 6, those block pieces open and close pivoting on this connecting pin (43). When a bridging portion (41*a*) formed between those block pieces is mounted onto the stay rotated perpendicularly to the plane of the fence component so as to place the weight container upon the stay with clamping both ends of the latter, the center of gravity of the fence component shifts to the downside thereof, so that it further enhances the standing stability of the fence component in addition to the rotation of the stay normal to the plane thereof.

Figure 7:
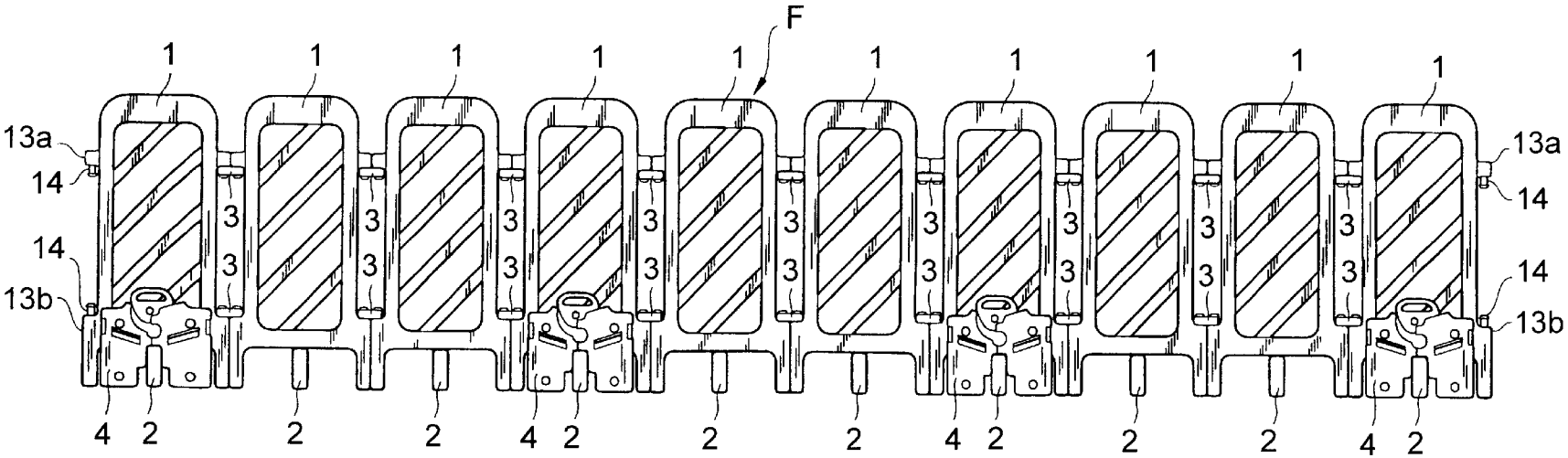
FIG. 7 is a frontal view showing the portable fence embodied in the present invention installed in a linear course and the stays rotated perpendicularly to the fence components with weight containers mounted on the stays as arbitrarily selected.
Figure 8:
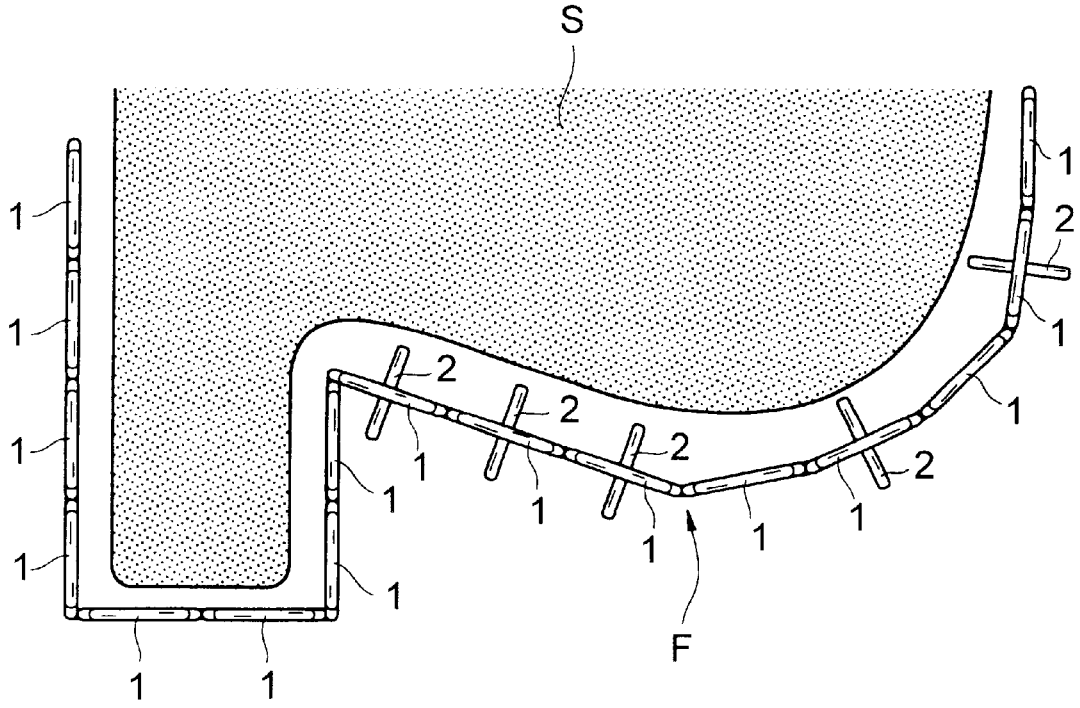
FIG. 8 is an installation example of the portable fence embodied in the present invention showing the fence installed in a restricted area with a sinuous course.

FIGS. 7 and 8 schematically show a portable fence of the present embodiment installed on the boundary of a keep-off area (S).

FIG. 7 shows the portable fence installed in a linear course. In this example, the fence stands supported by the stays disposed normal to the plane surface of the respective fence components and secures its standing stability by the weight (such as water) containers placed upon the first, fourth, seventh and tenth stays counted from the left side of the drawing. Normally, a portable fence developed in a linear course is somewhat poor at standing stability, but the fence embodied in the present invention stably stands just by relatively rotating the stays to the plane surface of the respective fence components, and with the weight containers as shown in FIG. 7 placed upon the stays as desired, it further enhances its standing stability.

In order to install the fence of the present invention, all the workers have to do is to carry it as compactly folded as shown in FIG. 5 to an installation site and to develop it there, so that they can carry out a series of work ranging from its storage, transportation to installation in a very efficient manner.

FIG. 8 shows the fence embodied in the present invention installed in the boundary of a complicated contour, in which case too, the fence can define a keep-off area in a stable and fast manner.

The preferred embodiment of the present invention has been substantially described up to here, but it is not limited to the above disclosure. It can be modified in various manners within the scope of the accompanying patent claims.

Figure 9:
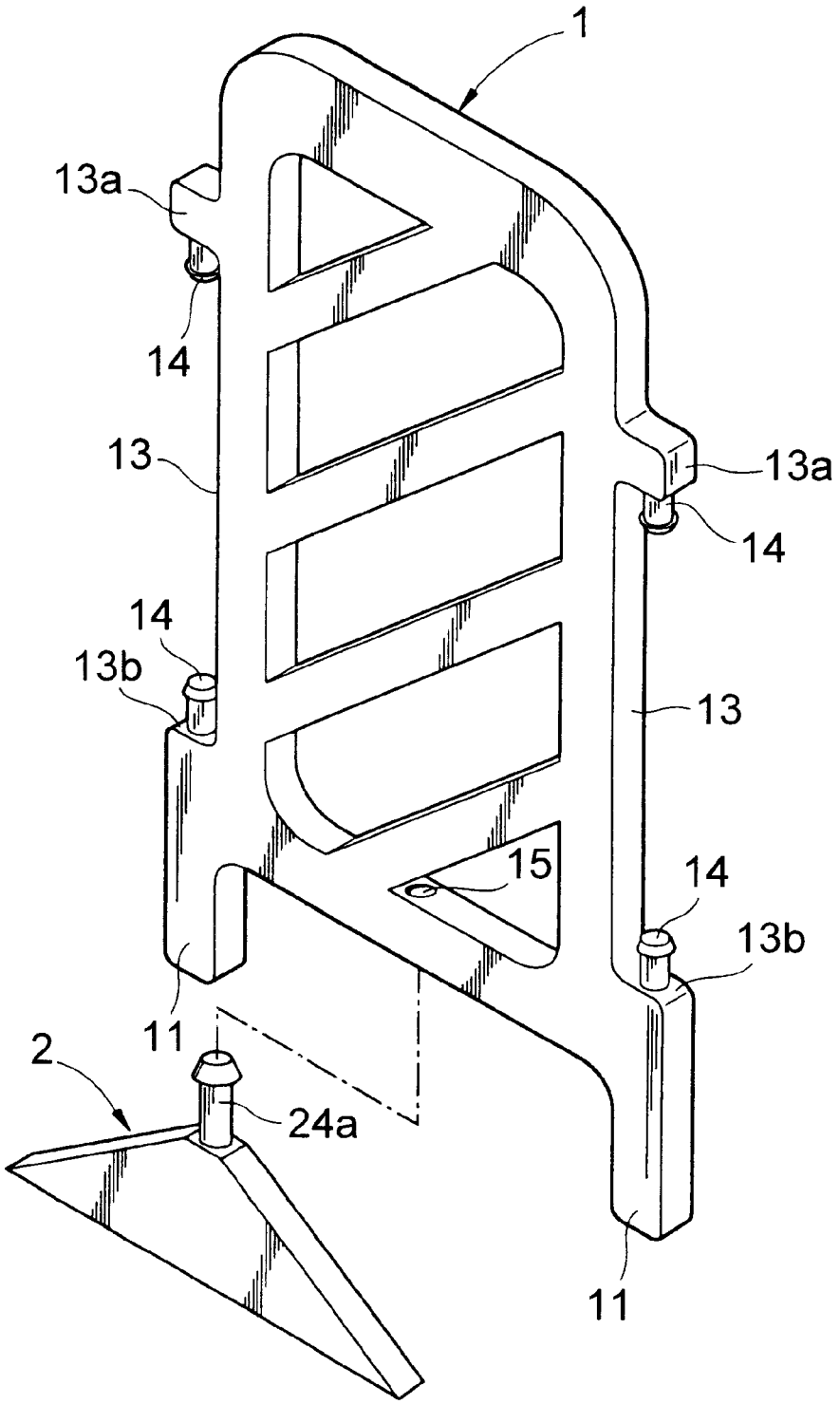
FIG. 9 is an exploded perspective view showing a modified embodiment of the stay for the portable fence embodied in the present invention.

For example, in the above-mentioned embodiment, though a stay (2) comprising a pair of mobile pieces (21) and (21), which interpose an stay pivot mount (12) provided on the lower part of a fence component therebetween, is pivotally mounted on said axis, it can be modified as shown in FIG. 9 such that a hole (15) is bored through the middle of the cut-out portion provided on the lower portion of a fence component, into which a pivot pin (24*a*)(24) provided at the apex of an isosceles-triangle stay is slid. Such modification naturally belongs to the technical scope of the present invention.

Also, in the above-mentioned embodiment, though it is shown that the respective stays are pivotally mounted onto the lower part of the respective fence components, if desired, it does not matter whether the stays are mounted onto only one fence component or some of those fence components. This modification also belongs to the technical scope of the present invention.

Further, in the above-mentioned embodiment, though it is exemplified that the adjacent components of the portable fence are connected to each other by means of bi-axial hinges, they can be arranged such that they are alternately connected to each other by means of a common hinge or some pieces of them are unremovedly hinged to each other as one unit, in which case, its commercialization is realized by adding further units as required. Such modification also belongs to the technical scope of the present invention.

As having been described up to here, a portable fence embodied in the present invention is easy and fast to be installed along the boundary of a zoning area having various contours in a stable manner just by relatively rotating the respective stays pivotally mounted onto the lower part of the respective fence components to the plane surface of the latters. Upon its storage and transportation, it can save a storing space and improves the efficiency of the transportation work due to its foldability and compactness.

As a plurality of the fence components is free to join and disjoin by means of bi-axial hinges, the extensive length of the fence can be adjusted as desired.

Accordingly, there are a number of favorable effects brought by the portable fence embodied in the present invention, so that its industrial applicability is very high.

What is claimed is:

1. A portable fence comprising:

a conjunction screen formed by connecting a plurality of fence components side-by-side through a hinge mechanism such that the fence components are foldable to each other;

wherein the adjacent fence components are connected to each other by biaxial hinge mechanisms;

wherein each of said fence components has a pair of protrusive portions on each side;

wherein biaxial hinge pins are mounted on each of said protrusive portions;

removable biaxial hinges having mounting holes which receive said biaxial hinge pins and completely surround said hinge pins;

further comprising a stay pivotally mounted to a lower portion of at least one fence component; said stay relatively rotating to a plain surface of the fence component so as to stabilize said component;

wherein said stay comprises a plurality of pieces which are assembled to encompass a stay pivot;

further comprising at least one hollow weight assembly having two hollow members for containing a weight material, wherein the two members are joined together by a connecting pin, and wherein said weight assembly overlays the stay.

2. The portable fence according to claim 1, wherein said biaxial hinge pins are attached at one end to said protrusive portions, and said pins extend outwardly from said protrusive portions which permits the biaxial hinge 5, to be fitted onto the hinge pins.

3. The portable fence in accordance with claim 2, wherein said hinge pins oppose each other along right and left sides of at least one fence component.

4. The portable fence according to claim 1, wherein said hinge pins have ends which oppose each other along right and left sides of at least one fence component.

5. The portable fence according to claim 1, wherein said biaxial hinges are detachable from the biaxial hinge pins so that the foldable components are free to join and disjoin.

6. A portable fence comprising:

a conjunction screen formed by connecting a plurality of fence components side-by-side through a hinge mechanism such that the fence components are foldable to each other;

a stay pivotally mounted on a lower fringe portion of said fence component, said stay relatively rotating to a plain surface of said fence component so as to stabilize said component;

wherein said stay comprises a plurality of pieces which are assembled to encompass a stay pivot mount;

further comprising a weight container which is rigid and which comprises at least two pieces which are attached together.

7. The portable fence accordance with claim 6, wherein said stay comprises two pieces which are attached together.

8. The portable fence according to claim 14, wherein each of said pieces are filled with sand or water.

9. The portable fence in accordance with claim 8, wherein said two attached pieces fold over a top of said stay pivot mount.

10. A portable fence comprising;

a conjunction screen formed by connecting a plurality of fence components side-by-side through a hinge mechanism such that the fence components are foldable to each other;

wherein said fence components each have protrusive portions at each side, said protrusive portions having biaxial hinge pins attached at one end to and extending from the protrusive portions;

wherein said pins extend in a direction where extended ends of the pins face each other;

wherein said fence components, said protrusive portions, and said biaxial hinge pins are a single piece of blow molded plastic; and wherein biaxial hinges are mounted to said pins.

11. The portable fence with according with claims 1, wherein the biaxial hinge pins have expanded diameter portions at an end and, wherein the expanded diameter portions retain the biaxial hinges.

12. The portable fence according with claim 2, wherein the biaxial hinge pins have expanded diameter portions at an end and, wherein the expanded diameter portions retain the biaxial hinges.

13. A portable fence according with claims 4, wherein the biaxial hinge pins have expanded diameter portions at an end and, wherein the expanded diameter portions retain the biaxial hinges.

14. The portable fence according with claim 10, wherein the biaxial hinge pins have expanded diameter portions at an end and, wherein the expanded diameter portions retain the biaxial hinges.

* * * * *

UNITED STATES PATENT AND TRADEMARK OFFICE

CERTIFICATE OF CORRECTION

PATENT NO. : 6,257,559 B1
DATED : July 10, 2001
INVENTOR(S) : Akihiro Mouri

It is certified that error appears in the above-identified patent and that said Letters Patent is hereby corrected as shown below:

Column 4,
Line 64, delete "(24)"

Column 5,
Line 63, delete "hinge 5," and substitute therefore -- hinges --

Column 6,
Line 22, after "fence", insert -- in --
Line 24, delete "14" and substitute therefore -- 6 --
Line 45, after "fence", delete "with"
Line 45, delete "claims" and substitute therefore -- claim --
Line 56, delete "claims" and substitute therefore -- claim --

Signed and Sealed this

Second Day of July, 2002

*Attest:*

*Attesting Officer*

JAMES E. ROGAN
*Director of the United States Patent and Trademark Office*